US011428509B1

(12) United States Patent
Brune

(10) Patent No.: US 11,428,509 B1
(45) Date of Patent: Aug. 30, 2022

(54) ADJUSTABLE TARGET STAND

(71) Applicant: Challenge Targets, LLC, Fort Thomas, KY (US)

(72) Inventor: Bradley T. Brune, Fort Thomas, KY (US)

(73) Assignee: Challenge Targets, LLC, Fort Thomas, KY (US)

( * ) Notice: Subject to any disclaimer, the term of this patent is extended or adjusted under 35 U.S.C. 154(b) by 138 days.

(21) Appl. No.: 17/140,500

(22) Filed: Jan. 4, 2021

Related U.S. Application Data

(60) Provisional application No. 62/956,698, filed on Jan. 3, 2020.

(51) Int. Cl.
*F41J 1/10* (2006.01)

(52) U.S. Cl.
CPC ..... *F41J 1/10* (2013.01)

(58) Field of Classification Search
CPC . F41J 1/10; A63B 71/023; E01F 9/673; E01F 9/677; E04H 12/2269
USPC ..... 248/519–520, 523
See application file for complete search history.

(56) References Cited

U.S. PATENT DOCUMENTS 6,491,303 B1 * 12/2002 Huston ..... F41J 1/10 273/407
2016/0258720 A1 * 9/2016 Côté ..... F41J 1/10

OTHER PUBLICATIONS

XMetal Targets, HMSS Wood Adapter Steel Target Stand, https://xmetaltargets.com/product/hmss-wood-adaptertarget-stand, archived Mar. 18, 2017 (Year: 2017).*

* cited by examiner

*Primary Examiner* — Laura Davison
(74) *Attorney, Agent, or Firm* — Wood Herron & Evans LLP

(57) ABSTRACT

Provided is a target support stand having a base comprising a pair of leg units with body portions situated substantially parallel to each other. Each body portion includes a first pair of corresponding fastener openings. A socket plate has a socket notch extending to an edge thereof and a second pair of fastener openings corresponding in position with the first pairs of fastener openings in the body portions. A separable upright support member has a tab portion sized to be received by the socket notch. The socket plate being clamped between leg units of the base by fasteners extending through the first fastener openings in the body portions and the second fastener openings in the socket plate to define at least one socket for removably receiving the tab portion of the upright support member in the socket notch between body portions.

11 Claims, 5 Drawing Sheets

ADJUSTABLE TARGET STAND

RELATED APPLICATIONS

This application claims priority to U.S. Provisional Patent Application No. 62/956,698, filed Jan. 3, 2020, and incorporates the same herein by reference.

TECHNICAL FIELD

This invention relates to a stand or support for holding items at some distance above the ground, particularly, targets. The stand can hold a generally upright support member in a vertical or angled position relative to a base in order to accommodate uneven ground and/or to position a target at an angle relative to vertical.

BACKGROUND

Various stands and supports are known for holding an item, such as a target, at some position above the ground. It is desirable to minimize the amount of material used to make such a stand, while providing an adjustable mechanism. Moreover, when supporting shooting targets, parts of a support stand are likely to be made from hardened metal, such as AR500 grade steel, which is weakened by welding.

SUMMARY OF THE INVENTION

The present invention provides a target stand that may be made with simple parts made from hardened steel plate. A socket plate is clamped between leg units to provide an angle-adjustable socket to receive an upright support member.

The design requires no welding, minimal drilling and bending, and is easily disassembled for compact transport/storage. A quick release mechanism allows the user to transport the target in a vehicle in a mostly flat condition and quickly erect the target in the field without tools.

The stand includes a mechanism that allows angular adjustment of the upright. When used as a support for paper or cardboard targets, a shooter wants the target to be presented upright (plumb to the ground) regardless of the terrain. When used with a steel target, the angle of deflection is important for many reasons. A shooting range may require different target angles for safety and deflection reasons. Increasing the angle helps reduce wear on the steel, however too much angle may prevent a bullet from fully fragmenting, which can cause ricochet hazards. The adjustable angle accommodates reactive steel targets because the angle can be used to change the amount of energy that is transferred into the target. Increasing the angle causes more energy to be required to displace a reactive target plate and transfers less of the bullet's energy into the plate. Less angle may be used for smaller/slower (lower kinetic energy) projectiles and more angle for faster/heavier projectiles.

The design requires as few secondary processes as possible (like forming and welding). By keeping most of the individual parts flat, they cost less to manufacture, are easier to ship, are easier to transport, and are easier to store when not being used.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
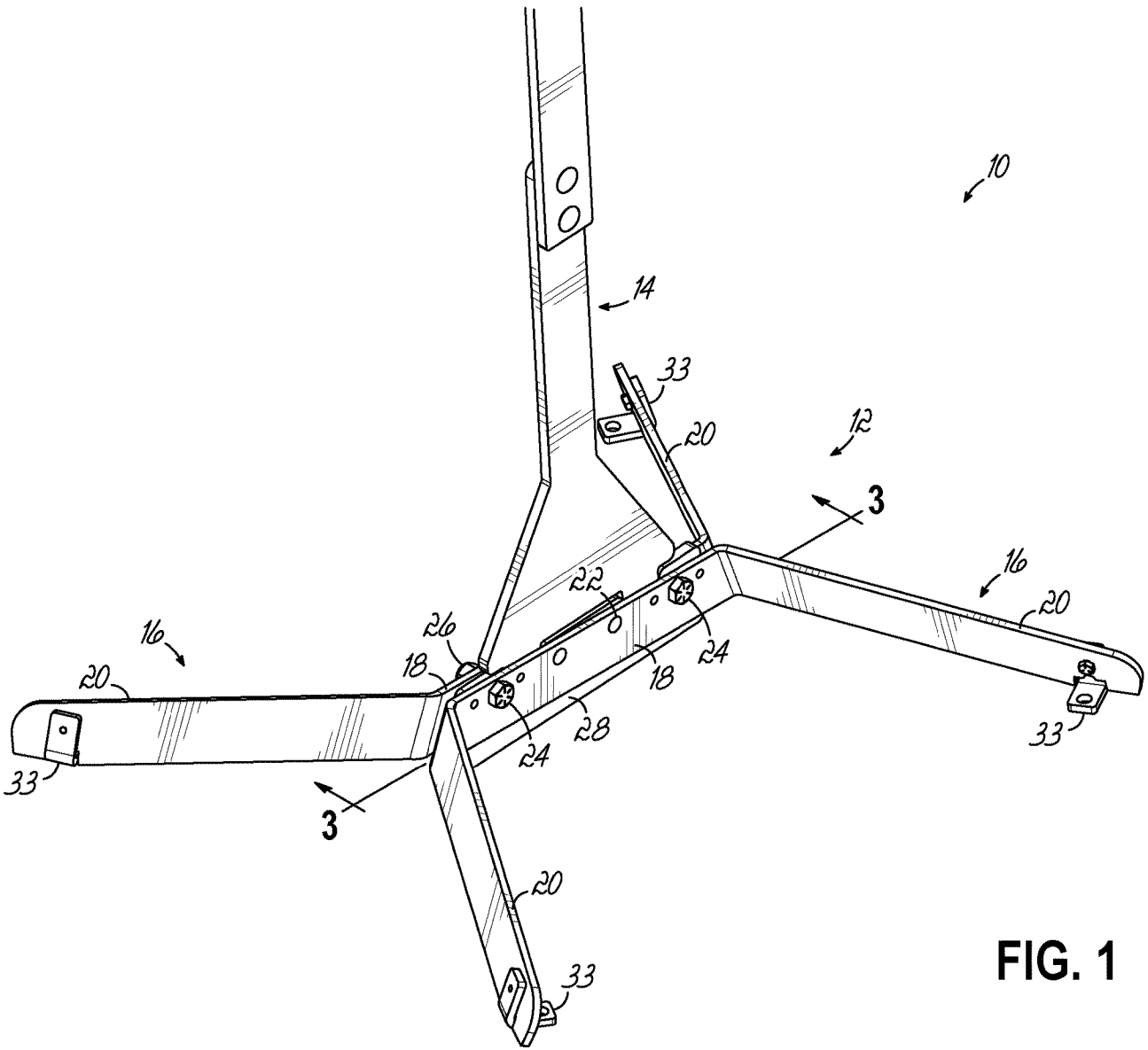
FIG. 1 is a pictorial view of an adjustable target stand according to one embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 2:
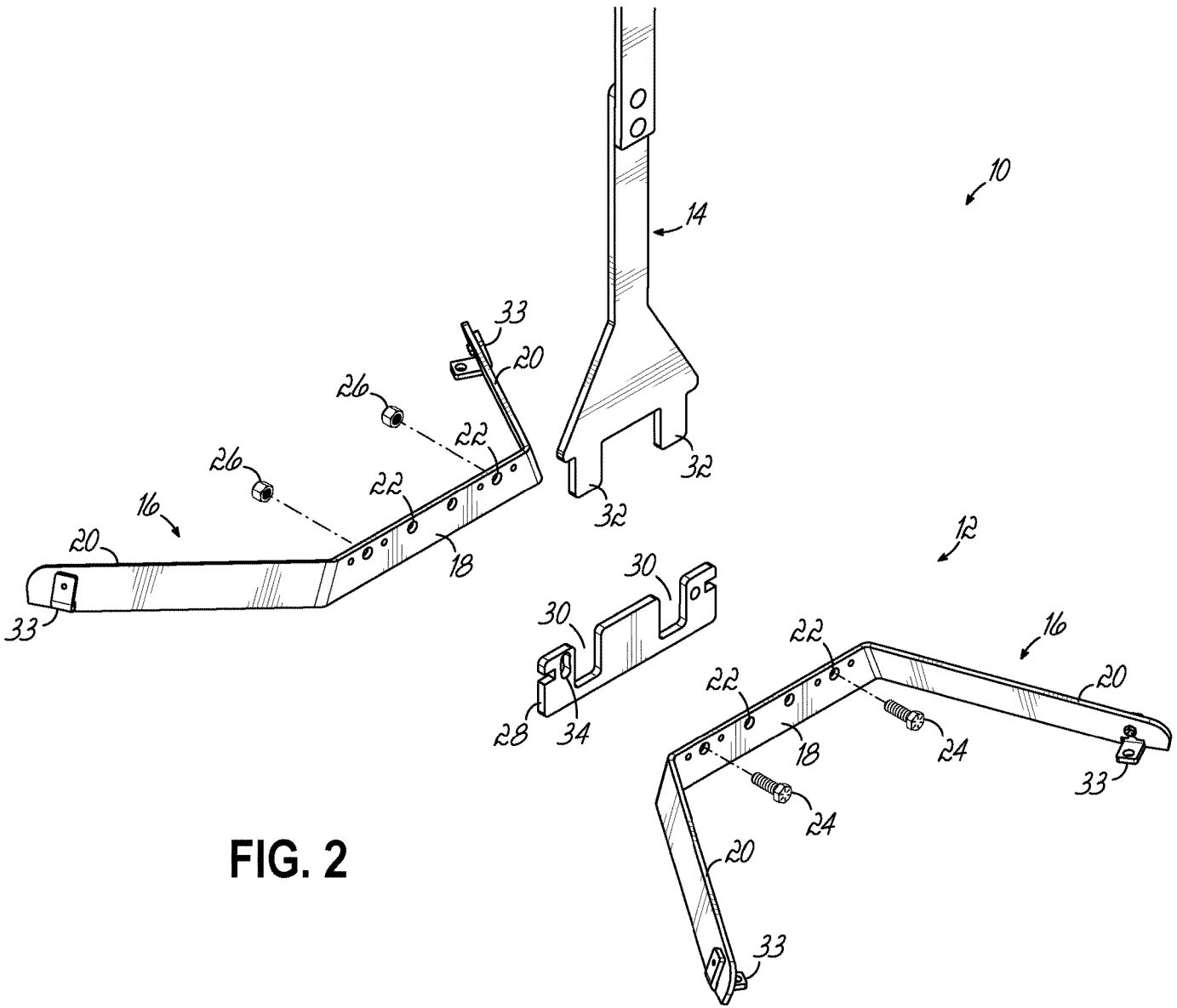
FIG. 2 is an exploded pictorial view thereof.

Referring first to FIGS. 1 and 2, the target stand 10 includes a base portion 12 and a separable upright support member 14. The connection between the base 12 and removable upright member 14 allows it to be quickly assembled or disassembled for transport, and allows the angle at which the upright portion 14 is held to be adjusted for uneven ground or to support an object, such as a target, at an angle relative to the shooter and/or relative to the ground.

The base portion 12 includes a pair of leg units 16. The leg units 16 have a middle portion 18 with legs 20 that are splayed outwardly and downwardly to provide spaced-apart contact with the ground or floor. The substantially parallel middle portions 18 may be drilled with a series of corresponding openings 22 that, with the use of fasteners (such as bolts 24 and nuts 26), allow a socket plate 28 to be clamped therebetween in a substantially parallel configuration. The socket plate 28 includes one or more socket notches 30 at an edge configured to receive one or more corresponding assembly tabs 32 on the upright member 14. The spaced-apart configuration of the notches/tabs 30, 32 steady the upright 14 against lateral forces in one direction and the length of the tabs 32 held in the notches 30 between the middle portions 18 of the leg units 16 steadies the upright 14 against lateral forces in the other direction. The leg units 16 may be interchangeable and can be nested for shipping or transport when fully disassembled.

As illustrated, the base portion 12, including the legs 16 and socket plate 28 may be made from regular A36 mild steel and the upright 14 may be made from hardened steel plate material, such as AR500, without any welding of parts. AR500 steel is a specific type of abrasion resistant, high-carbon steel alloy that provides impact and sliding abrasion resistance. However, this increase in strength and abrasion resistance will make the steel less malleable. The leg units 16 may be made from elongated, flat bar stock material and bent (as shown) at an angle to cause the legs 20 to angle outward and downward relative to the middle portion 18. The bends, which can weaken the material, are positioned to minimize their exposure to impact by a projectile. Feet 33 can be attached to ends of each leg 20, if desired, and/or they may allow the base 12 to be staked into the ground or bolted to a floor (in a well-known manner).

When clamped between the middle portions 18 of each leg unit 16, the socket notches 30 of the socket plate 28 provide a connection with the upright portion 14 that resists dislodging when the upright 14 is struck from any direction by a projectile. By using material for the socket plate 28 that is slightly greater in thickness than that of the assembly tabs 32 of the upright 14, the socket plate 28 may be firmly clamped between the leg units 16 while allowing easy insertion and removal of the assembly tabs 32 from the socket notches 30. Thus, the upright 14 can be separated from the base 12 without the use of tools for relatively flat and compact transport/storage, or to interchange the type/length/style of the supported target.

Figure 3:
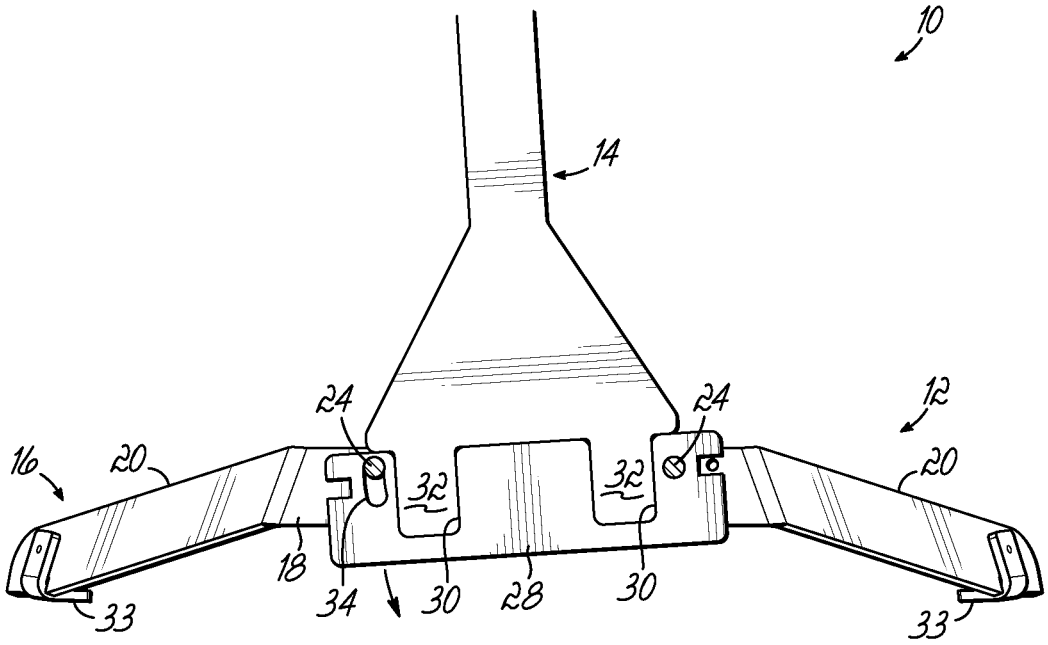
FIG. 3 is a sectional view taken substantially along line 3-3 of FIG. 1.
Figure 4:
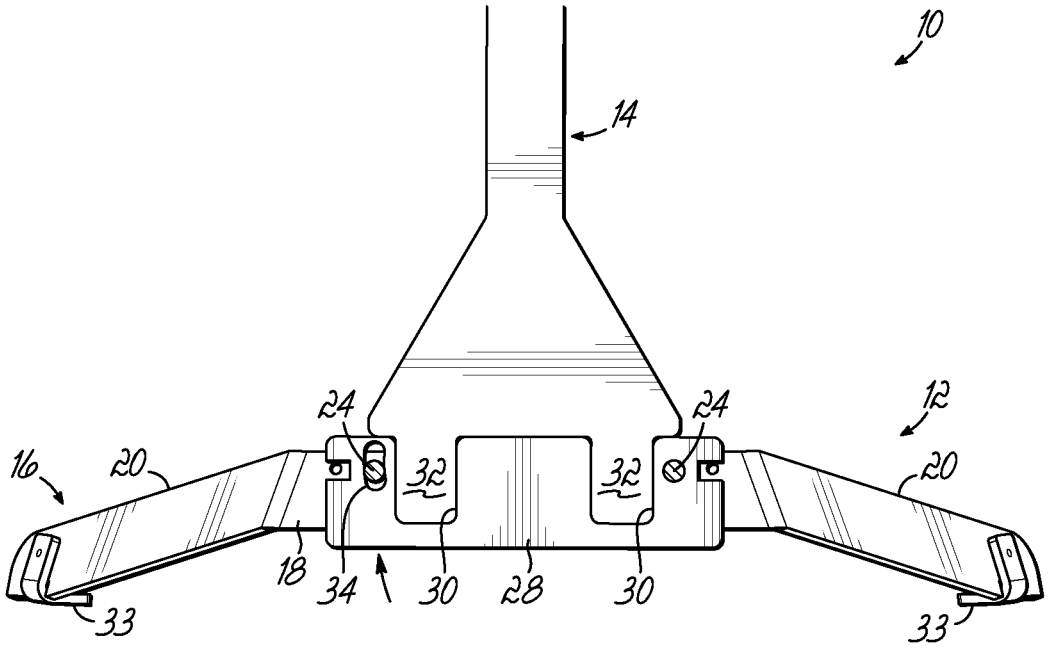
FIG. 4 is a similar view with the support adjusted to a vertical position.

As illustrated in FIGS. 3 and 4, at least one of the bolt openings 34 in the socket plate 28 may be elongated (such as in an arcuate extension) to allow the socket plate 28 to be pivotably repositioned (shown by arrows) relative to the other attachment bolt 24, which acts as a pivot axis. As previously described, this allows the angle of the upright 14 relative to the base portion 12 to be adjusted, as desired, to compensated for an uneven support surface or to angle the upright 14 (and the target it holds) relative to the shooter and/or the ground.

Figure 5:
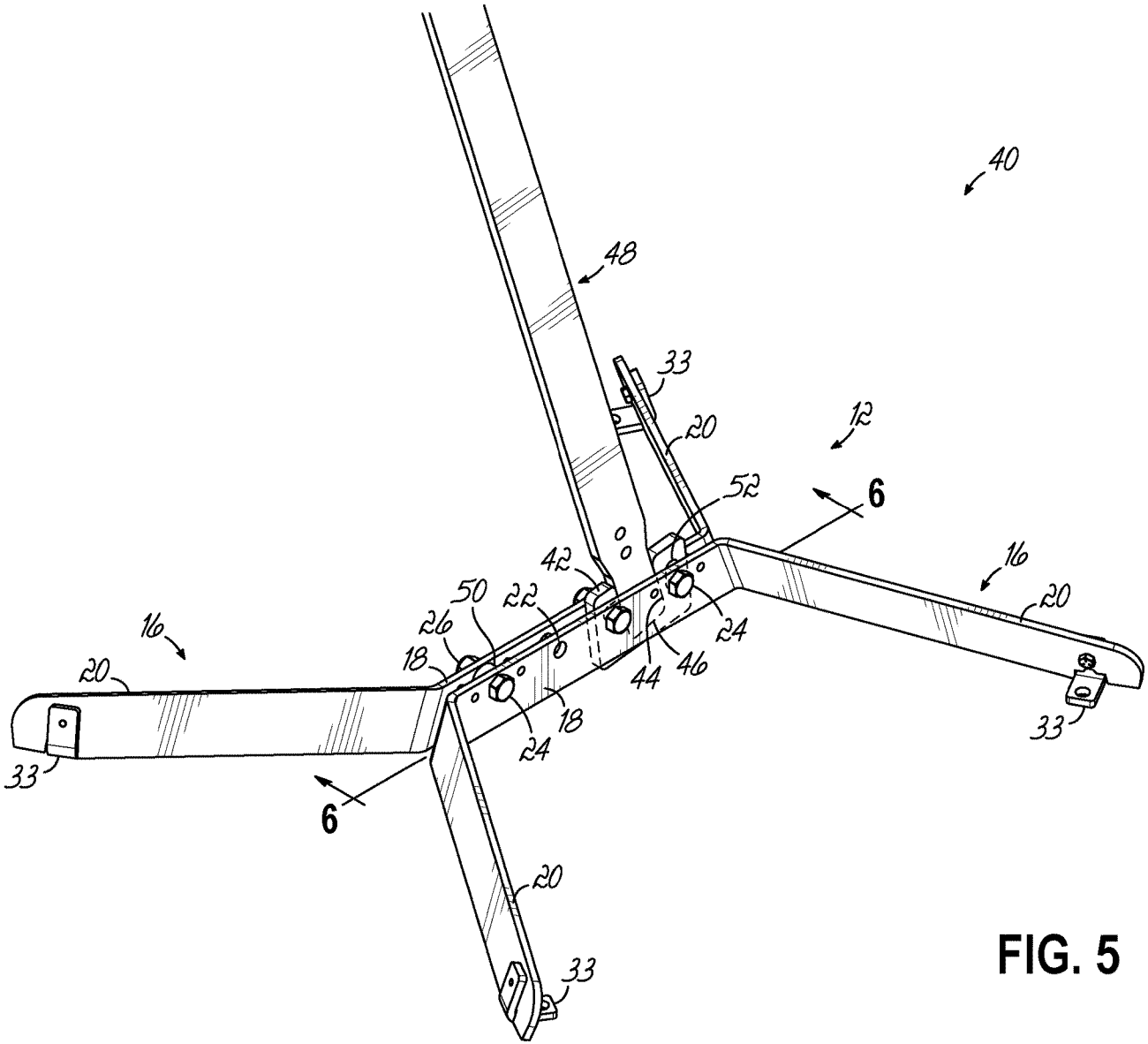
FIG. 5 is a pictorial view of a second embodiment of the invention.
Figure 6:
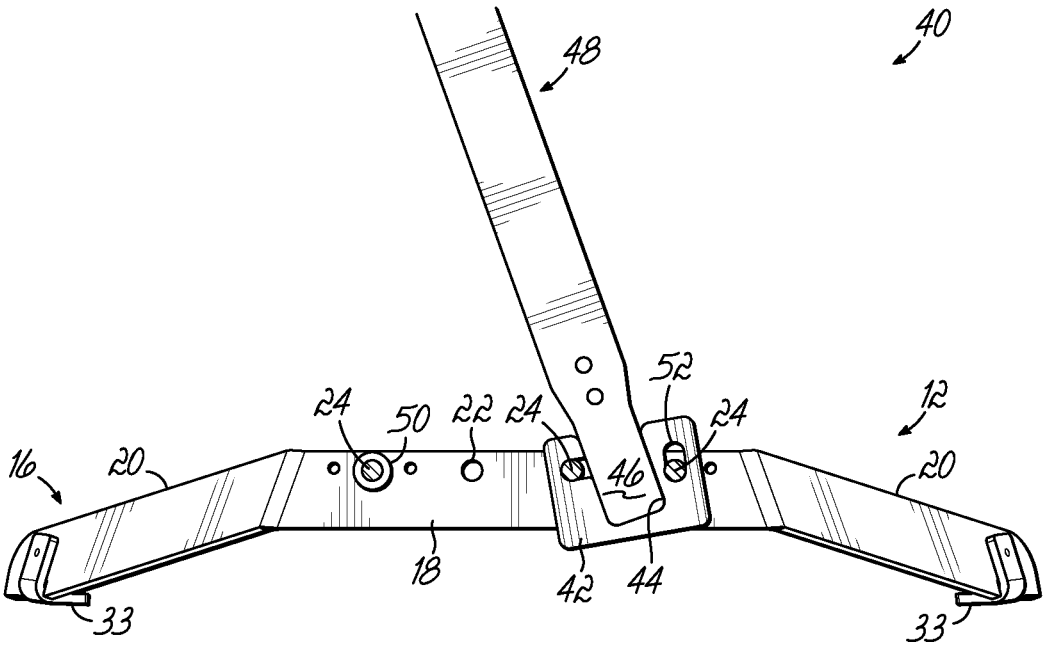
FIG. 6 is a sectional view thereof taken substantially along line 6-6 of FIG. 5.

Referring now to FIGS. 5 and 6, therein is shown an alternate embodiment target stand 40 of the present invention. In this embodiment, the leg units 16 may be substantially identical to those described above. An alternate socket plate 42 may be used, having a single socket notch 44 to receive a single assembly tab 46 of an upright member 48. In this embodiment, the assembly bolts 24 may be spaced closer together and the socket plate 42 positioned nearer to one end of the middle portion 18 (as shown) or near the center (not shown). If desired, a third assembly bolt/nut 24, 26 may be used with a spacer 50 positioned between the middle portions 18 of the leg units 16 for proper alignment. As described in the first embodiment 10, above, the socket plate 42 may include an elongated (and arcuate) slot 52 that allows the angle of the upright member 48 to be selectively angled.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A target support stand, comprising:

a base comprising a pair of leg units with body portions situated substantially parallel to each other, each body portion including a first pair of corresponding fastener openings;

a socket plate having a socket notch extending to an edge thereof, a second pair of fastener openings corresponding in position with the first pairs of fastener openings in the body portions; and a separable upright support member having a tab portion sized to be received by the socket notch, the socket plate being clamped between leg units of the base by fasteners extending through the first fastener openings in the body portions and the second fastener openings in the socket plate to define at least one socket for removably receiving the tab portion of the upright support member in the socket notch between body portions.

2. The support stand of claim 1, wherein an angle is defined between the upright support member and the base, the angle being adjustable by adjustably positioning the socket plate between the body portions.

3. The support stand of claim 2, wherein one of the second fastener openings in the socket plate is an elongated slot and the other is a pivot point, the position of the socket plate being adjustable relative to the body portions by pivoting the socket plate on the fastener extending through the other of the second fastener openings.

4. The support stand of claim 3, wherein the elongated slot is arcuate.

5. The support stand of claim 1, wherein the fasteners include threated bolts and nuts.

6. The support stand of claim 1, wherein the upright support member includes at least one flange portion extending transversely relative to the tab such that, when the tab is inserted in the socket, the flange portion bears against an edge of the socket plate.

7. The support stand of claim 6, wherein the flange portion bears against an edge of the socket plate adjacent the socket notch.

8. The support stand of claim 1, wherein each body portion has opposite ends and leg portions extend from each end, each leg portion extending at an angle relative to the body portion and one of the leg portions of the other leg unit.

9. The support stand of claim 1, wherein the socket plate includes a plurality of socket notches.

10. The support stand of claim 9, wherein the upright support includes multiple tabs positioned to correspond to the socket notches.

11. The support stand of claim 1, wherein the socket plate and the tab portion have thicknesses and the thickness of the socket plate is greater than the thickness of the tab portion.

* * * * *